US007178369B2

(12) United States Patent
Azzalin et al.

(10) Patent No.: US 7,178,369 B2
(45) Date of Patent: Feb. 20, 2007

(54) MULTI-PURPOSE SEAL WITH LOCK

(75) Inventors: Graziano Azzalin, Oleggio (IT); Christophe Korn, Ferrera Di Varese (IT); Andre Poucet, Cittiglio (IT)

(73) Assignee: European Community, Brussels (BE)

( * ) Notice: Subject to any disclaimer, the term of this patent is extended or adjusted under 35 U.S.C. 154(b) by 0 days.

(21) Appl. No.: 10/513,325

(22) PCT Filed: May 7, 2003

(86) PCT No.: PCT/EP03/50150

§ 371 (c)(1),
(2), (4) Date: May 18, 2005

(87) PCT Pub. No.: WO03/095773

PCT Pub. Date: Nov. 20, 2003

(65) Prior Publication Data

US 2005/0210932 A1 Sep. 29, 2005

(30) Foreign Application Priority Data

May 13, 2002 (EP) ..... 02291188

(51) Int. Cl.
*E05B 67/38* (2006.01)

(52) U.S. Cl. ..... 70/50; 70/53; 70/434; 70/435

(58) Field of Classification Search ..... 70/50, 70/435, 434, 439, 440, 408, 20–49, 53, 433; 292/307 R; 340/542; 29/464, 592
See application file for complete search history.

(56) References Cited

U.S. PATENT DOCUMENTS 1,515,302 A * 11/1924 George ..... 70/38 R
2,666,318 A * 1/1954 Welch ..... 70/50
4,766,419 A 8/1988 Hayward
4,811,578 A * 3/1989 Masoncup et al. ..... 70/38 B
5,422,627 A * 6/1995 Tap et al. ..... 340/542
5,482,008 A * 1/1996 Stafford et al. ..... 119/174
5,632,168 A * 5/1997 Yano ..... 70/278.3

(Continued)

FOREIGN PATENT DOCUMENTS

DE 298 23 528 7/1999

(Continued)

OTHER PUBLICATIONS

Wade Landrum, "Encrypta Offer Three New Products" Locksmith Ledger International, Cygnus Business Media, vol. 60, No. 5, pp. 26-28, 30, Apr. 2000.

*Primary Examiner*—Lloyd A. Gall
(74) *Attorney, Agent, or Firm*—Oblon, Spivak, McClelland, Maier & Neustadt, P.C.

(57) ABSTRACT

A multipurpose seal with a lock, including a mobile closure apparatus of a casing containing a lock and an attachment element designed to be locked in the casing. The lock includes a barrel configured to move in the casing between a locked position and an unlocked position. A remote-interrogatable electronic component including a data-storage is maintained in a housing, which passes through part of the casing and part of the lock barrel when the lock barrel is in the locked position. Thus, any rotation of the barrel from the locked position causes the component to break.

19 Claims, 3 Drawing Sheets

U.S. PATENT DOCUMENTS

| | | | | |
|---|---|---|---|---|
| 6,265,973 | B1 * | 7/2001 | Brammall et al. | 340/568.1 |
| 2005/0231365 | A1 * | 10/2005 | Tester et al. | 340/568.1 |

FOREIGN PATENT DOCUMENTS

| | | |
|---|---|---|
| EP | 0 863 489 | 9/1998 |
| EP | 1 063 627 | 12/2000 |
| GB | 2 368 174 | 4/2002 |

* cited by examiner

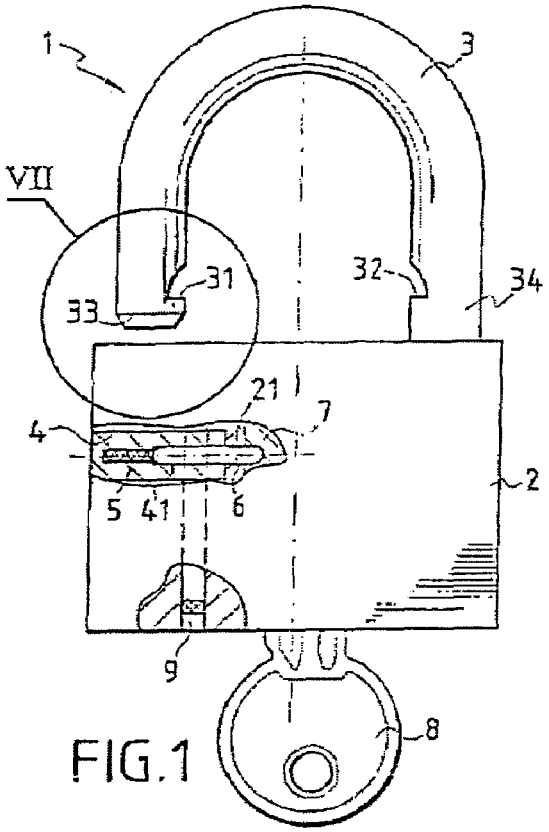
FIG.1
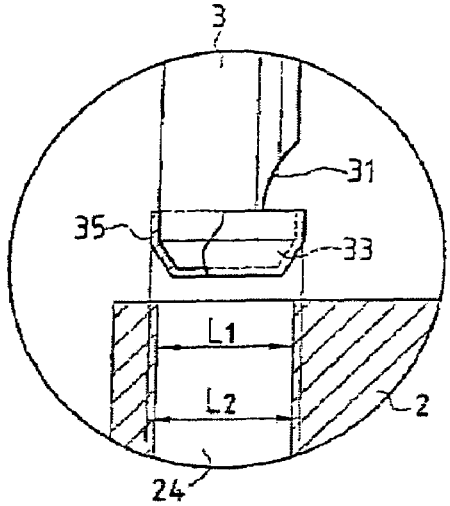
FIG.7
FIG.3
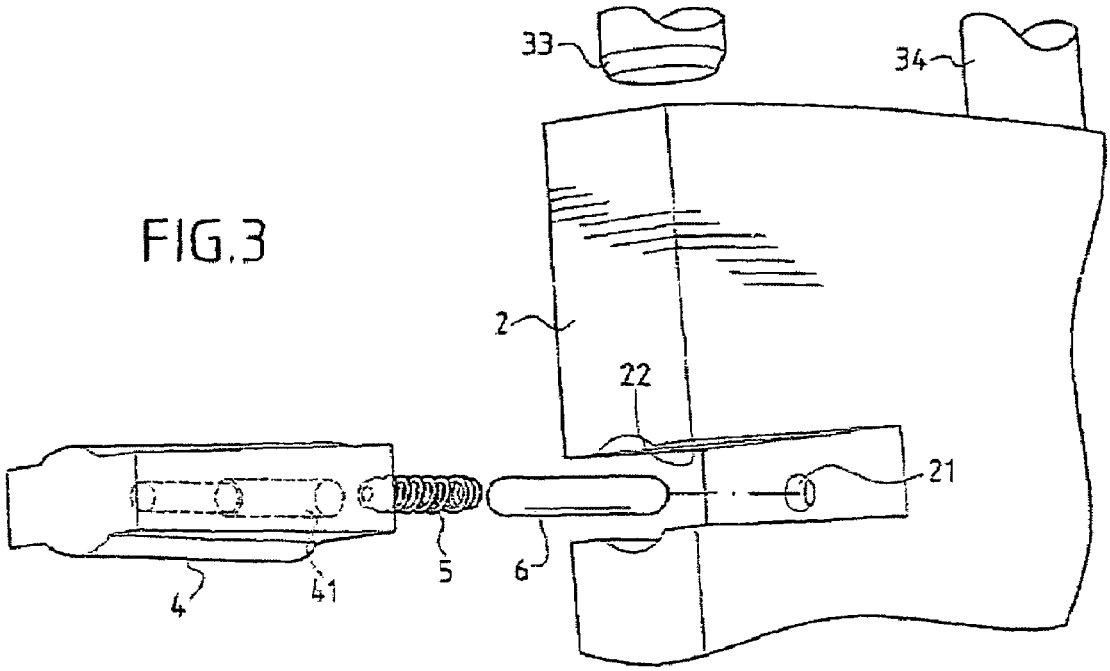

MULTI-PURPOSE SEAL WITH LOCK

FIELD OF THE INVENTION

The present invention relates to a seal device for closing and marking objects. More specifically, the invention relates to seal devices employing electronic identification means.

PRIOR ART

Many types of seal are currently in use for monitoring the routing or storage of products or hardware which have fairly important monitoring or safety needs, such as nuclear material, certain types of waste, or money, for example.

The technologies used to produce seals are highly varied and depend chiefly on the use and the demanded level of security.

Thus, when the matter is simply that of ensuring the integrity of an object, such as a bag or a box, the function of the seal is to guarantee that the object has not been opened without authorization. In this case, inexpensive devices such as simple plastic or metal bands fixed to the members for opening the object may be used. A simple visual inspection of the integrity of the structure of the bands is then enough to tell whether or not the seal has been tampered with.

On the other hand, there are an increasing number of fields in which the seals have not only to fulfil their basic function, which is that of testifying to the fact that the object has not been tampered With, but must also provide information during their use. Thus, there are currently devices in existence which comprise mechanical sealing means with which electronic or optical means are associated for storing and transmitting information.

However, the current seal devices, which comprise electronic means are complicated and expensive. They are generally designed for a specific purpose and cannot be used with any arbitrary object. In addition, they have a delicate mechanical structure, which makes them very sensitive to handling and transport and further restricts their use.

PURPOSE AND BRIEF DESCRIPTION OF THE INVENTION

The present invention sets out to overcome the aforementioned disadvantages and to produce a multi-purpose seal device of low cost, which is mechanically robust and contains information that can be consulted simply and quickly. The device must also allow a reliable and easy check of the integrity of the seal.

These objects are achieved by virtue of a multi-purpose seal with a lock, comprising a mobile closure apparatus formed of a casing containing a lock and of an attachment element intended to be locked into the casing, the lock comprising a barrel able to move in the casing between a locked position and an unlocked position, characterized in that it further comprises a remote-interrogatable electronic component which comprises a data-storage means, the component being held in a housing which passes through part of the casing and part of the lock barrel when the latter is in the locked position.

Thus, by virtue of the seal according to the invention, the electronic component, which allows information to be stored and transmitted also becomes the evidence of the integrity of the seal. The integrity of the component is checked by remotely interrogating it, something, which does not require any removal of the seal.

According to one particular aspect of the invention, a holding element is fixed in the casing to hold the electronic component in the housing.

More specifically, the holding element comprises a cavity designed to accommodate part of the electronic component, a spring being arranged between the bottom of the cavity and the electronic component.

In order to strengthen the fixing of the holding element in the casing, the seal may further comprise a fixed pin which immobilizes the holding element in the casing.

The data-storage means of the electronic component may comprise data-encryption means. It may also be of the programmable or multipage type.

According to one feature of the invention, the electronic component is a passive transponder of the injectable transponder type used for animals.

According to another feature of the invention, the seal comprises a removable means for preventing the attachment element from being locked in the casing.

The mobile closure apparatus may be a padlock or an antitheft device of the bicycle lock type.

Another subject of the present invention is a method of manufacturing a multi-purpose seal comprising a mobile closure apparatus formed of a casing containing a lock and of an attachment element, the lock comprising a barrel able to move in the casing between a position in which the attachment element is locked and one in which it is unlocked, characterized in that it comprises the following steps:

a) drilling an opening which passes through part of the casing and part of the lock barrel when it is in the locked position, and b) installing, in the opening, a remote-interrogatable electronic component comprising a data-storage means.

According to one particular aspect of the invention, the method further comprises the following steps:

c) machining a recess in the casing ahead of the opening, and d) fixing an element for holding the electronic component in said recess.

More specifically, the holding element comprises a cavity intended to accommodate part of the electronic component, a spring being arranged between the bottom of the cavity and the electronic component.

The method may further comprise a step e) of fixing a pin to immobilize the holding element in the casing.

It may also comprise an additional step f) of installing a removable means for preventing the attachment element from being locked in the casing.

According to one feature of the invention, the data-storage means of the electronic component comprises data-encryption means. It may also be of the programmable or multipage type.

According to one particular aspect of the invention, the electronic component is a passive transponder of the injectable transponder type used for animals.

The mobile closure apparatus may be a padlock or alternatively an antitheft device of the bicycle lock type.

BRIEF DESCRIPTION OF THE DRAWINGS

Other features and advantages of the invention will become apparent from the following description of some particular embodiments of the invention, given by way of nonlimiting examples with reference to the attached drawings in which:

FIG. 1 is a schematic view of a seal with a lock in an unlocked position according to a first embodiment according to the invention, FIG. 3 is an exploded perspective view of part of the seal according to a first embodiment.

FIG. 7 is an enlargement of detail VII of FIG. 1.

DETAILED DESCRIPTION OF THE EMBODIMENTS OF THE INVENTION

In order not to make the description needlessly more complicated, the present invention will essentially be described in conjunction with a mobile closure apparatus of the padlock type. However, it will become clearly evident that the present invention applies to any type of mobile closure apparatus comprising a casing containing a lock mechanism that can be actuated by turning a barrel using a key or the like.

FIGS. 1 to 5 show one embodiment of a seal according to the invention.

Figure 2:
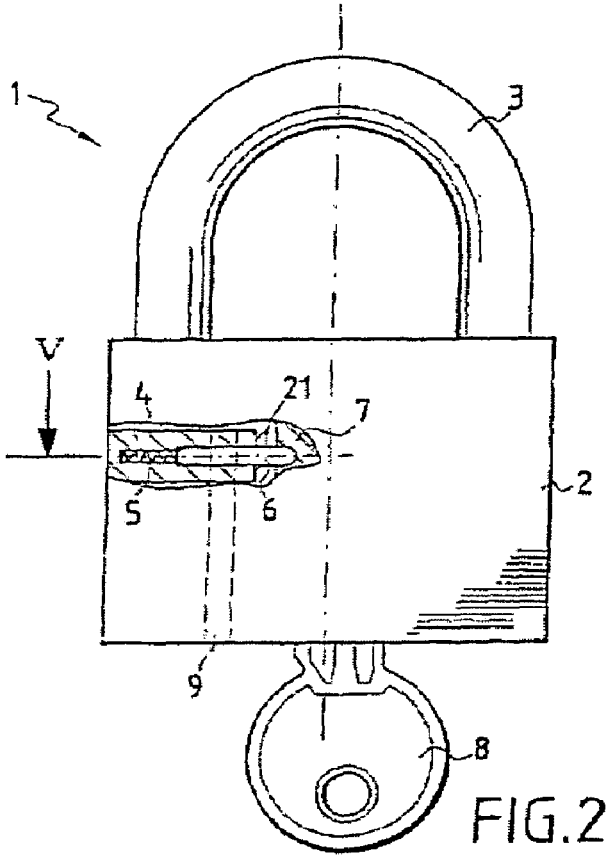
FIG. 2 is a schematic view of a seal with a lock in a locked position according to a first embodiment of the invention.
Figure 5:
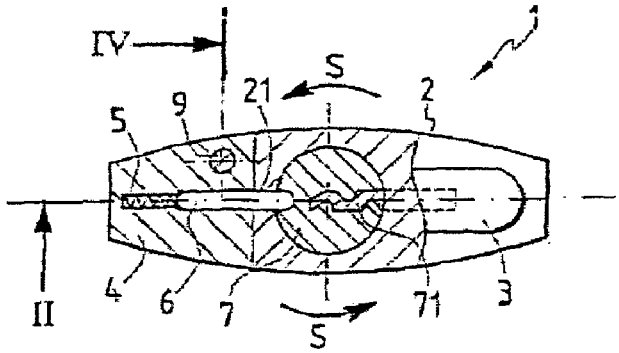
FIG. 5 is a schematic view in section on the plane V of FIG. 2, according to a first embodiment of the invention.

In this first embodiment, the seal is made of a padlock 1 which mainly comprises a casing 2 and an attachment element 3 such as a metal bow. The casing 2 contains a lock mechanism intended to lock at least one of the ends of the attachment element 3. As depicted in FIG. 1, the attachment element 3 comprises a free end 33 equipped with a notch 31 intended to take a bit (not depicted) of the lock mechanism for locking. The other end 34 of the element 3 is held in the casing 2 in such a way as to allow the element 3 to rotate about this end when the padlock is unlocked. As for the end 31, the end 34 may also comprise a notch 32 intended to accommodate a locking bit. In a known way, the means of locking the lock mechanism of the casing 2 are actuated in the unlocking direction by turning a barrel 7 about its axis using a key 8 inserted beforehand into a keyhole slot (71) in the lock barrel 7 (FIG. 5). It is also known that this type of padlock can be locked without having to use the key, that is to say without turning the lock barrel. What happens is that when no force is applied to the barrel by the key 8, the padlock is equipped with a return mechanism, which keeps the barrel 7 in a position of rest as illustrated in FIGS. 1 and 2. In addition, the bit or bits intended to engage in the notch or notches of the attachment element 3 are also mounted with return springs which keep them in the position in which the attachment element is locked as long as the lock barrel is not actuated by turning it in the unlocking direction S (FIG. 5). In certain types of padlock, the lock barrel may be actuated in both directions in order to unlock the attachment element. To close the padlock, all that is required is for pressure to be applied to the element 3 to move it in terms of translation towards the casing 2 and thus lower its ends into the casing, doing so without moving the barrel. The lock mechanism, which consists in immobilizing or in freeing the ends of the attachment element 3, is well known in itself and will not be described further in detail.

Figure 4:
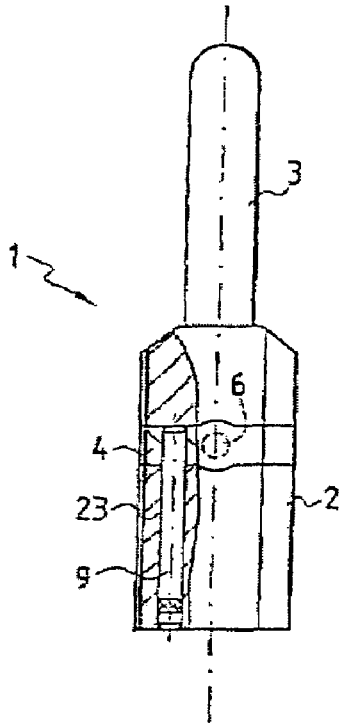
FIG. 4 is a schematic side view of the seal according to a first embodiment.

According to the invention, the casing 2 is modified so as to be able to accommodate an electronic component 6 which can be mechanically broken. For this, as depicted in FIG. 3, a bore 21 is machined into the side of the casing 2 to form a housing for the component 6. In this embodiment, the component 6 is held in the bore 21 by an element 4 which comprises a cavity 41 in which there are arranged a spring 5 and part of the component 6. For this, a recess 22, the shape of which corresponds to that of the element 4, is also machined in the casing 2, ahead of the bore 21. Thus, once the element 4 is fixed in the casing, the component 6 is held in abutment against the bottom of the bore 21 by the spring 5, itself in abutment against the end of the cavity 41 of the element 4. The element 4 may be fixed in the recess 22 of the casing simply by means of bonding. However, the fixing of the element 4 in the casing may be strengthened by a pin 9 arranged in a passage 23 drilled in the casing and in a portion of the element 4 that does not comprise the cavity 41 (FIG. 4).

As illustrated in FIGS. 1, 2 and 5, the bore 21 extends both into part of the casing 2 and into part of the barrel 7 of the lock part of the padlock. The portion of the bore 21 situated in the casing and the portion of the bore 21 situated in the barrel 7 are aligned only when the latter is in the locked position. In other words, the bore 21 forms a common housing in the casing and the barrel for the component 6 only when the barrel is in the locked position, that is to say its rest position.

What is important is for the depth of the bore 21 in the barrel 7 not to exceed the length of the component 6, this being so as to guarantee that the latter, once held in abutment in the bottom of the bore 21, will be present both in the barrel 7 and in the casing 2 (FIG. 5). By way of example, in the embodiment described here, the depth of the bore 21 in the barrel 7 is about 2 mm. Thus, the component 6 opposes any rotational movement of the barrel 7 with respect to the casing 2, which forms a stator. Because of its mechanical weakness, any attempt at unlocking the padlock by actuating the barrel will cause the component to break. In consequence, the integrity of the seal according to the invention is afforded by the mechanical, and therefore electronic, integrity of the component.

An electronic component, which can be used in the seal according to the invention is a remote-interrogatable passive electronic component such as a transponder of the type injected or implanted in pets to identify them. A transponder is a device, which transmits the information it holds in memory when activated by an emitter-receiver. It may possibly store new information.

More specifically, such an electronic component comprises an electronic circuit, which comprises means forming an antenna, such as a coil wound around a ferrite core, and an electronic part essentially made up of memory means. The antenna-forming means serve not only to transmit the data but also to receive an activating field to electrically power the electronic circuit.

One example of a passive transponder that may be used in the present invention is a model (B T-IS 6110 with an industry and non-animal identity code in accordance with ISO 11784) by DATAMARS SA. This model of transponder comprises a miniature electronic circuit, which is encapsulated in a very small sized glass cylinder, namely one 14 mm long and 2 mm in diameter. The electronic circuit comprises a 128-bit memory, which may be programmable or multi-page (transponder of the "full duplex" (FDX) type).

Figure 6:
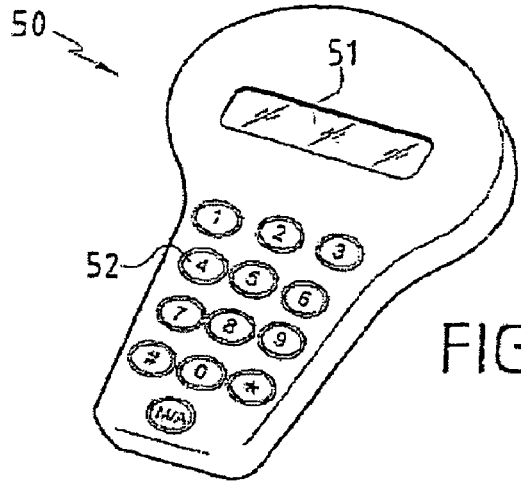
FIG. 6 is a perspective view of one example of a portable reader.

The data stored in the transponder, such as the identity of the seal or information regarding the seal content, may be read for example using a portable reader 50 depicted in FIG. 6. Such a reader may in particular have a display screen 51, a keypad 52 and/or means for storing the interrogated data. The reader activates the transponder by radiofrequency (RF), for example at a frequency of 134.2 kHz. This wave charges a capacitor present in the transponder circuit. As this capacitor discharges, it sends back a code or information written in the transponder memory to the reader.

The code and/or the information from each interrogated transponder are thus sent to the reader 50 and displayed on its screen 51 and/or stored in its memory, or transferred, via a serial connection, to a computer. Software may make it possible to make the correlation between the identity number of the seal (the code from the transponder) and various data such as, for example, the place and/or the name of the inspector who fitted the seal, and/or the date on which the seal was affixed. The system thus formed allows the data from the seal to be read from a distance, which may be as much as about 30 cm away, which is sufficient for most applications.

The type of transponder described hereinabove is particularly suited to the present invention. Indeed, such components have a very small bulk and this allows them to be housed easily in small mobile closure apparatuses such as padlocks. In addition, as the encapsulation protecting the circuit is made of glass, it can be broken easily and thus allow the electronic circuit to be destroyed with little resistance, particularly to the shear force applied to the component as the lock barrel is turned.

Thus, by virtue of this seal design specific to the invention, the integrity of this seal can be checked very simply and quickly even though it is not visible. Indeed, any attempt at tampering with the seal by opening the padlock is sanctioned by mechanical destruction of the component. Thus, the integrity of the component, and therefore that of the seal, will be checked using a reader. If the component does not respond to interrogation by the reader, that means that the electronic circuit thereof has suffered damage and that the integrity of the seal is questionable.

According to the principle of the seal, the seal can be affixed just once without affecting its integrity. The seal according to the invention meets the same requirements. The seal comes in the configuration depicted in FIG. 1, that is to say with the attachment element 3 unlocked so that it can be slipped, for example, through the eyes or closed rings of a bag or the like that is to be closed in a tamperproof way. Once the padlock has been locked, the seal according to the invention is in the configuration depicted in FIG. 2 where the attachment element is locked in the casing 2. This configuration corresponds to the seal affixed and any attempt at opening the padlock will lead to destruction of the component and therefore of the seal.

In order to prevent any inadvertent closing of the padlock and therefore loss of the seal while it is being transported or handled prior to use, removable means may be provided on the attachment element, the casing or both. An example of such means is illustrated in FIG. 7. In this figure, the free end 33 of the attachment element 3 is covered with a cap 35 of which the width $L_2$ is greater than the width $L_1$ of the orifice 24 of the casing 2 in which the end 33 is housed so as to be locked. Thus, as long as the end of the attachment element is covered with the cap, this end cannot be introduced into the orifice 24. Alternatively, inadvertent closure of the padlock can be prevented by removable means present on the casing 2, such as a sticker or a diaphragm obstructing the orifice 24. The removable means may just as easily consist of a removable or breakable spacer piece, arranged between the casing and the upper part of the attachment element 3 to hold the latter a given distance away thus preventing the free end from entering the casing.

Figure 8:
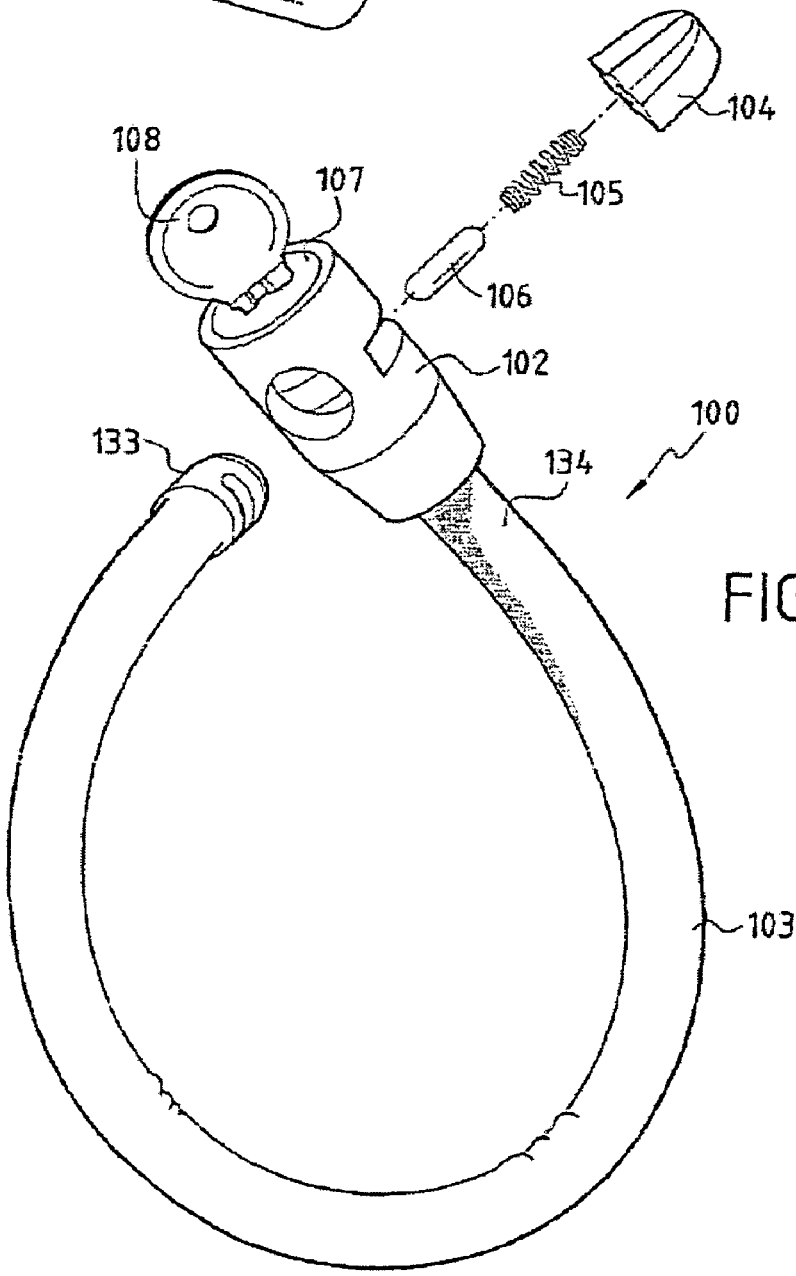
FIG. 8 is a perspective view of a seal according to a second embodiment of the invention.

FIG. 8 shows another embodiment of a multi-purpose seal according to the invention. In this embodiment, a seal is made from a mobile closure apparatus 100 of the bicycle lock type. The attachment element 103 consists of a steel cable or chain, possibly covered with a plastic sleeve, one end 134 of which is fixed to a casing 102 containing a lock mechanism. The other end 133 of the attachment element 103 is left free when not locked in the casing 102. Just as in the previous embodiment, the casing 102 is modified to accommodate a component 106 of the same type as the one described above, the latter being held between a part of the casing 102 and of the lock barrel 107 by means of an element 104 and of a spring 105. Any turning of the barrel 107 using a key 108 will lead to destruction of the component 106.

The embodiment set out in FIG. 7 works in a similar way to the one described in conjunction with FIGS. 1 to 5 and may, obviously, have all the particular characteristics described above. For simplification purposes, it will therefore not be described further in detail.

The seal according to the invention has the following advantages.

The information, such as an identification code, can be read without removing or adversely affecting the seal when the seal is affixed. By virtue of the glass encapsulation protecting the electronic circuit, the transponder is watertight and resistant to chemical attack. In consequence, the information can be read even under particular storage conditions. Thus, for example, the data stored in the seal may be read when the seal is submerged.

The use of a reader to identify and interrogate the seal makes the checking work easier. The reader need merely be taken to each of the sites to be checked. It is not necessary for each of the seals to be taken to a laboratory or an analysis centre to make use of special-purpose opening and reading means.

The data stored in the seal may easily be stored, by virtue of a simple serial computer connection. The extracted data can therefore be processed quickly, thus speeding up and lowering the cost of identification.

It is possible to use multipage transponders in order to store various information, such as information about the nature, the provenance, the routing steps or the starting point of the sealed hardware or product, thus further increasing the possibilities of the seal. When routing in several stages, for example, the information may be useful to determine the place or date of any tampering with the seal.

When the transponder circuit comprises programmable or encryptable means, it is possible to encode or encrypt the data stored in the seal, hence giving a higher level of security.

The seal has a low cost of manufacture (about 10 euros depending on the quantity produced for a seal manufactured starting from a padlock).

The integrity of the seal is checked simply and quickly: if the reader cannot read the information stored, then the seal has been tampered with.

The seal has significant mechanical robustness allowing it to be used as a reliable closure apparatus. In addition, once affixed, the seal requires no special precautions to protect its integrity. Indeed, the integrity indicator, namely the component, is protected within the closure apparatus against any destruction that could arise while the sealed object is being handled.

It is also possible to have one single key for a number of closure apparatuses used as seals according to the invention. This simplifies their use still further.

The invention claimed is:

1. A multi-purpose seal with a lock, comprising:

a mobile closure apparatus formed of a casing containing a lock;

an attachment element configured to be locked into the casing, said lock comprising a lock barrel configured to move in the casing between a locked position and an unlocked position;

a holding element fixed in a recess of said casing; and a remote-interrogatable electronic component that comprises a data-storage, said component being held by said holding element in a housing that passes through part of the casing and part of the lock barrel when the lock barrel is in the locked position.

2. A seal according to claim 1, wherein the holding element comprises a cavity configured to accommodate part of the electronic component, and wherein a spring is arranged between a bottom of the cavity and the electronic component.

3. A seal according to claim 1, further comprising a fixed pin configured to immobilize the holding element in the casing.

4. A seal according to claim 1, wherein the data-storage of the electronic component comprises a data-encryption mechanism.

5. A seal according to claim 1, wherein the data-storage of the electronic component is of programmable or multipage type.

6. A seal according to claim 1, wherein the electronic component comprises a passive transponder of injectable transponder type used for animals.

7. A seal according to claim 1, further comprising removable means for preventing the attachment element from being locked in the casing.

8. A seal according to claim 1, wherein the mobile closure apparatus comprises a padlock.

9. A seal according to claim 1, wherein the mobile closure apparatus comprises an antitheft device of bicycle lock type.

10. A method of manufacturing a multi-purpose seal including a mobile closure apparatus formed of a casing containing a lock and an attachment element, said lock including a lock barrel configured to move in the casing between a position at which the attachment element is locked and a position at which the attachment element is unlocked, the method comprising:

drilling an opening, said opening passing through part of the casing and part of the lock barrel when the lock barrel is in the locked position;

machining a recess in the casing;

installing, in said opening, a remote-interrogatable electronic component comprising a data-storage; and fixing, in said recess, a holding element for holding the electronic component.

11. A method according to claim 10 wherein the recess is machined in the casing ahead of the opening.

12. A method according to claim 11, wherein the holding element includes a cavity configured to accommodate part of the electronic component, and wherein a spring is arranged between a bottom of the cavity and the electronic component.

13. A method according to claim 10, further comprising:

fixing a pin to immobilize the holding element in the casing.

14. A method according to claim 10, further comprising:

installing removable means for preventing the attachment element from being locked in the casing.

15. A method according to claim 10, wherein the data-storage of the electronic component comprises a data-encryption mechanism.

16. A method according to claim 10, wherein the data-storage of the electronic component is of programmable or multipage type.

17. A method according to claim 10 wherein the electronic component comprises a passive transponder of injectable transponder type used for animals.

18. A method according to claim 10, wherein the mobile closure apparatus comprises a padlock.

19. A method according to claim 10, wherein the mobile closure apparatus comprises an antitheft device of bicycle lock type.

* * * * *